US008203549B2

(12) United States Patent
Ohnuki et al.

(10) Patent No.: US 8,203,549 B2
(45) Date of Patent: Jun. 19, 2012

(54) PLASMA DISPLAY PANEL DRIVING METHOD AND PLASMA DISPLAY APPARATUS

(75) Inventors: Hidenori Ohnuki, Kawasaki (JP); Akihiro Machida, Awa (JP); Yoshinori Okada, Yokohama (JP); Tomohiro Mitou, Yokohama (JP); Satoshi Yuri, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 825 days.

(21) Appl. No.: 12/340,270

(22) Filed: Dec. 19, 2008

(65) Prior Publication Data

US 2009/0244042 A1 Oct. 1, 2009

(30) Foreign Application Priority Data

Mar. 25, 2008 (JP) ..... 2008-078803

(51) Int. Cl.
*G09G 5/00* (2006.01)

(52) U.S. Cl. ..... 345/211; 345/60; 345/62; 345/63; 345/212; 345/213; 345/214; 345/215

(58) Field of Classification Search ..... 345/60–73, 345/211–215
See application file for complete search history.

(56) References Cited

U.S. PATENT DOCUMENTS

| | | | | |
|---|---|---|---|---|
| 5,171,652 | A | 12/1992 | Umetani | |
| 2005/0161733 | A1 * | 7/2005 | Cho et al. | 257/328 |
| 2005/0218822 | A1 | 10/2005 | Sano et al. | |
| 2006/0001603 | A1 * | 1/2006 | Kang et al. | 345/60 |
| 2006/0152448 | A1 | 7/2006 | Hatanaka et al. | |
| 2007/0013309 | A1 | 1/2007 | Han | |

FOREIGN PATENT DOCUMENTS

| | | |
|---|---|---|
| JP | 3269451 | 12/1991 |
| JP | 11-259035 | 9/1999 |

(Continued)

OTHER PUBLICATIONS

Korean Office Action issued in Korean Patent Application No. 10-2008-0109843, dated Jul. 9, 2010.

(Continued)

*Primary Examiner* — Nitin Patel
*Assistant Examiner* — Saifeldin Elnafia
(74) *Attorney, Agent, or Firm* — McDermott Will & Emery LLP

(57) ABSTRACT

A plasma display panel driving method and a plasma display apparatus are disclosed in which a suitable address discharge can be performed at a next scanning timing by reducing voltage changes in a sustain electrode and a scan electrode caused by a change of an address pulse when the address pulse is applied to an address electrode at a scanning timing. The plasma display panel driving method drives a plasma display panel which includes plural scan electrodes extending in a first direction and plural address electrodes extending in a second direction orthogonal to the first direction. In the method, a negative polarity scan pulse is applied to a scan electrode, a positive polarity address pulse is applied to an address electrode from an address electrode driving circuit, and an address discharge is generated. The positive polarity address pulse is generated by using a charge sharing system, in which before clamping a predetermined high voltage or a predetermined low voltage to the address electrode, an averaged voltage generated from electric charges remaining in the plural address electrodes is applied to the address electrode. A falling time of the address pulse is longer than a rising time of the address pulse.

8 Claims, 9 Drawing Sheets

FOREIGN PATENT DOCUMENTS

| | | |
|---|---|---|
| JP | 2004-271875 | 9/2004 |
| JP | 2005-210119 | 8/2005 |
| JP | 2006-195423 | 7/2006 |
| KR | 10-2007-0008355 | 1/2007 |
| KR | 10-2007-0072668 | 7/2007 |
| KR | 10-2007-0081727 | 8/2007 |
| KR | 10-2008-0023328 | 3/2008 |

OTHER PUBLICATIONS

Korean Office Action issued in Korean Patent Application No. 10-2008-0109843, dated Dec. 27, 2010.

* cited by examiner

PLASMA DISPLAY PANEL DRIVING METHOD AND PLASMA DISPLAY APPARATUS

BACKGROUND OF THE INVENTION

1. Field of the Invention

The present invention relates to a plasma display panel driving method and a plasma display apparatus in which an address discharge is generated by outputting an address pulse from an address electrode driving circuit.

2. Description of the Related Art

Conventionally, as an effective energy collecting method for an integrated circuit which needs high voltage operations such as a driver integrated circuit of a plasma display apparatus, an energy collecting circuit of a charge sharing system has been known.

As the energy collecting circuit of the charge sharing system, for example, a circuit is well known that includes a pull-up element and a pull-down element connected to an output terminal, an energy collecting capacitor, and a switching element connected between the energy collecting capacitor and the output terminal. In the energy collecting circuit of the charge sharing system, a power source voltage terminal, the pull-up element, the output terminal, the pull-down element, and a ground terminal are connected in order in a totem pole shape, and the energy collecting capacitor is connected to the output terminal via the switching element.

An example of the operations of the energy collecting circuit of the charge sharing system is described. When the voltage of the output terminal rises from ground potential to a power source voltage, the switching element is turned ON while the pull-up element and the pull-down element are OFF, and the voltage of the output terminal is raised by the electric charges stored in the energy collecting capacitor. Then the voltage of the output terminal has risen to a predetermined intermediate voltage, the switching element is turned OFF and the pull-up element is turned ON, and the voltage of the output terminal is clamped to be the power source voltage. On the other hand, when the voltage of the output terminal falls from the power source voltage to ground potential, the switching element is turned ON while the pull-up element and the pull-down element are OFF, and the voltage of the output terminal is lowered by storing electric charges in the energy collecting capacitor. Then the voltage of the output terminal falls to the predetermined intermediate voltage, the switching element is turned OFF and the pull-down element is turned ON, and the voltage of the output terminal is clamped to be ground potential.

For example, when the energy collecting capacitors of adjacent address pulse outputting circuits of the plasma display panel can be connected to be a short circuit, electric charges stored in the energy collecting capacitors can be shared between the adjacent address pulse outputting circuits. That is, the stored electric charges can be shared in all of the address electrode driving circuits. With this, energy saving can be performed (see Japanese Laid-Open Patent Publication No. 2005-210119: Patent Document 1).

In the energy collecting circuit of the charge sharing system, periods are required for increasing to the predetermined intermediate voltage and for decreasing to the predetermined intermediate voltage. Therefore, a generating time of the address pulse becomes long. On the other hand, a high-definition and high-brightness plasma display panel has been required, and the generating time of the address pulse (address time) is required to be short. In order to achieve the above, for instance, the address time is shortened by making the shifting time to the power source voltage or ground potential shorter than the charging (increasing)/discharging (decreasing) time to/from the predetermined intermediate voltage.

FIG. 8 is a diagram showing a voltage transition of an address pulse with the passage of time in a conventional charge sharing system. In FIG. 8, an intermediate voltage VDH/2 is supplied to an address electrode by the charge sharing system in MODE 1, a power source voltage VDH is supplied to the address electrode by clamping the power source voltage VDH in MODE 2, the intermediate voltage VDH/2 is supplied to the address electrode by the charge sharing system in MODE 3, and ground potential is supplied to the address electrode by clamping ground potential in MODE 4. In this, in order to shorten one address pulse period, it is determined that the fall time in MODE 4 is to be shorter than the fall time in MODE 3.

However, in the electrode driving circuit of Patent Document 1, since the plasma display panel has capacitive loads, when a voltage applied to an electrode has a steep change, this steep change influences other electrodes and a large voltage change is generated in the other electrodes.

FIG. 9 is an equivalent circuit of a discharge cell $C_{nm}$ of a plasma display panel. In FIG. 9, when an address discharge is generated in the discharge cell $C_{nm}$ at a position where a scan electrode $Y_n$ of an $n^{th}$ row crosses an address electrode $A_m$ of an $m^{th}$ column, a negative scanning pulse is applied to the scan electrode $Y_n$ and a positive address pulse is applied to the address electrode $A_m$, so that the address discharge is generated in a capacitive load $C_{ay}$. As shown in FIG. 9, in the discharge cell $C_{nm}$ of the plasma display panel, in addition to the capacitive load $C_{ay}$, a capacitive load $C_{ax}$ is formed between the address electrode $A_m$ and the sustain electrode $X_n$, and a capacitive load $C_{xy}$ is formed between the sustain electrode $X_n$ and the scan electrode $Y_n$. That is, a capacitive coupling is formed in the discharge cell $C_{nm}$. Therefore, when a voltage to be applied to the address electrode $A_m$ has a steep change, this steep change causes a large voltage change in the sustain electrode $X_n$ and the scan electrode $Y_n$.

For example, when a fall of an address pulse of an address electrode $A_m$ at a scanning timing is steep, voltages to be applied to a sustain electrode $X_n$ and a scan electrode $Y_n$ are changed, and these voltage changes promote a defect in generating a wall electric charge at an address discharge of the next scanning timing. When a sufficient wall electric charge is not generated at the address discharge, a sustain discharge is not suitably performed, and there is a risk that a discharge cell $C_{nm}$ will not be capable of emitting light.

SUMMARY OF THE INVENTION

In a preferred embodiment of the present invention, there is provided a plasma display panel driving method and a plasma display apparatus in which a suitable address discharge can be performed at a next scanning timing by reducing voltage changes in a sustain electrode and a scan electrode caused by a change of an address pulse when the address pulse is applied to an address electrode at a scanning timing.

In this, since voltage changes in the sustain electrode and the scan electrode at a steep rise of an address pulse have been confirmed to be small by the inventers of the present invention with a limiting resistor and other components that are used between a power source voltage supplying circuit and an address pulse outputting circuit, the matter of the steep rise of the address pulse is not described.

According to one aspect of the present invention, there is provided a plasma display panel driving method for driving a plasma display panel which includes plural scan electrodes extending in a first direction and plural address electrodes extending in a second direction orthogonal to the first direction. In the method, a negative polarity scan pulse is applied to one of the scan electrodes, a positive polarity address pulse is applied to one of the address electrodes from an address electrode driving circuit, and an address discharge is generated. The positive polarity address pulse is generated by using a charge sharing system, in which before clamping a predetermined high voltage or a predetermined low voltage to one of the address electrodes, an averaged voltage generated from electric charges remaining in the plural address electrodes is applied to one of the address electrodes, and the falling time of the address pulse is longer than the rising time of the address pulse.

With this, when the address pulse is applied to the address electrode, changes of voltages to be applied to the sustain electrode and the scan electrode can be reduced, a defective address discharge at the next scan timing can be reduced, and a suitable address discharge can be performed.

According to another aspect of the present invention, in the method, a period required for the address pulse to fall to the predetermined low voltage by clamping is 2 or more times a period required for the address pulse to rise to the predetermined high voltage by clamping and is one address pulse period or less.

With this, the period required for the address pulse to fall to the predetermined low voltage by clamping can be a sufficiently long time, and the voltage changes of the sustain electrode and the scan electrode caused by a steep change of the address pulse at the falling time can be surely reduced.

According to another aspect of the present invention, in the method, the period required for the address pulse to fall to the predetermined low voltage by clamping is 2 or more times and 5 or less times the period required for the address pulse to rise to the predetermined high voltage by clamping.

With this, the period required for the address pulse to fall to the predetermined low voltage by clamping can be a long time within a suitable range, and the voltage changes of the sustain electrode and the scan electrode can be surely reduced without making the one address pulse remarkably long.

According to another aspect of the present invention, in the method, the period required for the address pulse to fall to the predetermined low voltage by clamping is longer than the period required for the address pulse to fall to the averaged intermediate voltage by the charge sharing system.

With this, the voltage changes of the sustain electrode and the scan electrode can be more surely reduced at the period required for the address pulse to fall to the predetermined low voltage by clamping.

According to another aspect of the present invention, there is provided a plasma display apparatus. The plasma display apparatus includes a plasma display panel which provides plural scan electrodes extending in a first direction and plural address electrodes extending in a second direction orthogonal to the first direction, and an address electrode driving circuit which generates an address discharge by applying a positive polarity address pulse to one of the address electrodes when a negative polarity scan pulse is applied to one of the scan electrodes. The address electrode driving circuit includes a first switching element for a charge sharing system which applies an averaged voltage generated from electric charges remaining in the plural address electrodes to one of the address electrodes before clamping a predetermined high voltage or a predetermined low voltage to one of the address electrodes, a second switching element for high voltage clamping which clamps the predetermined high voltage to one of the address electrodes, and a third switching element for low voltage clamping which clamps the predetermined low voltage to one of the address electrodes. The current capacity of the third switching element is smaller than the current capacity of the second switching element.

With this, falling of the address pulse to the predetermined low voltage by clamping can be gentle with the passage of time, the voltage changes of a sustain electrode and the scan electrode can be reduced, a defective address discharge at a next scan timing can be reduced, and a suitable address discharge can be performed.

According to another aspect of the present invention, in the plasma display apparatus, a period from when the address electrode turns ON the third switching element to when the address electrode becomes the predetermined low voltage is 2 or more times a period from when the address electrode turns ON the second switching element to when the address electrode becomes the predetermined high voltage, and is one address period or less.

With this, a falling time of the address pulse to the predetermined low voltage by clamping can be a sufficiently long time, and the voltage changes of the sustain electrode and the scan electrode caused by a steep change of the address pulse at the falling time can be surely reduced.

According to another aspect of the present invention, in the plasma display apparatus, the period from when the address electrode turns ON the third switching element to when the address electrode becomes the predetermined low voltage is 2 or more times and 5 or less times the period from when the address electrode turns ON the second switching element to when the address electrode becomes the predetermined high voltage.

With this, the falling time of the address pulse to the predetermined low voltage by clamping can be a long time within a suitable range, and the voltage changes of the sustain electrode and the scan electrode can be surely reduced without making the address pulse remarkably long.

According to another aspect of the present invention, in the plasma display apparatus, the period from when the address electrode turns ON the third switching element to when the address electrode becomes the predetermined low voltage is longer than a period from when the address electrode applies the predetermined high voltage to when the address electrode becomes an averaged voltage generated from electric charges remaining in the plural address electrodes by turning ON the first switching element.

With this, the falling of the address pulse can be gentle, and the voltage changes of the sustain electrode and the scan electrode can be more surely reduced.

According to an embodiment of the present invention, an address discharge can be suitably performed, and a defective address discharge can be reduced.

BRIEF DESCRIPTION OF THE DRAWINGS

Features and advantages of the invention will become more apparent from the following detailed description when read in conjunction with the accompanying drawings, in which.

DETAILED DESCRIPTION OF THE PREFERRED EMBODIMENT

In the following, a preferred embodiment of the present invention is described with reference to the drawings.

Figure 1:
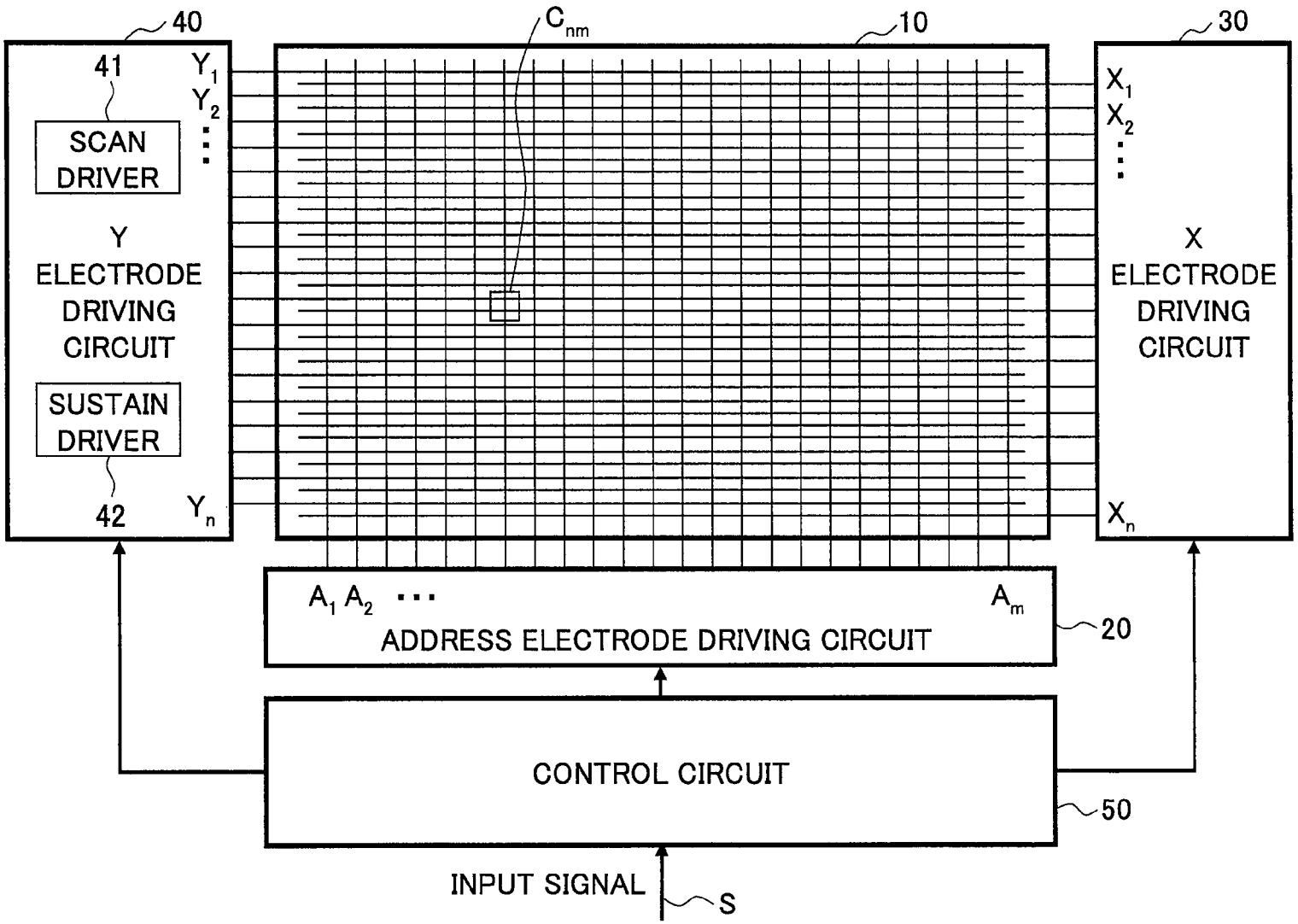
FIG. 1 is a structural diagram showing a plasma display apparatus according to an embodiment of the present invention.

FIG. 1 is a structural diagram showing a plasma display apparatus according to an embodiment of the present invention. As shown in FIG. 1, the plasma display apparatus according to the embodiment of the present invention includes a plasma display panel 10, an address electrode driving circuit 20, an X electrode driving circuit 30, a Y electrode driving circuit 40, and a control circuit 50.

An image is displayed on the plasma display panel 10. The plasma display panel 10 includes plural sustain electrodes (X electrodes) $X_1, X_2, X_3, \ldots$, and $X_n$ extending in the horizontal direction (lateral direction), and plural scan electrodes (Y electrodes) $Y_1, Y_2, Y_3, \ldots$, and $Y_n$ extending in the horizontal direction. In the following, in some cases, the electrode(s) $Y_n$ having a suffix "n" represents each scan electrode or the plural scan electrodes, and the electrode(s) $X_n$ having a suffix "n" represents each sustain electrode or the plural sustain electrodes. In addition, the plasma display panel 10 includes plural address electrodes $A_1, A_2, A_3, \ldots$, and $A_m$ extending in the vertical direction (longitudinal direction). In the following, in some cases, the address electrode(s) $A_m$ having a suffix "m" represents each address electrode or the plural address electrodes.

The sustain electrodes $X_n$ and the scan electrodes $Y_n$ extending in the horizontal direction are alternately stacked in the vertical direction. At a position where the sustain electrode $X_n$ and the scan electrode $Y_n$, cross the address electrode $A_m$ in the planar view of FIG. 1, a discharge cell $C_{nm}$ (display cell) is formed. The discharge cell $C_{nm}$ corresponds to a pixel, and the plasma display panel 10 can display a two-dimensional image by utilizing the discharge cells $C_{nm}$. In the discharge cell $C_{nm}$, a space exists among the sustain electrode $X_n$, the scan electrode $Y_n$, and the address electrode $A_m$; and corresponding capacitive loads are formed between the sustain electrode $X_n$ and the scan electrode $Y_n$; the sustain electrode $X_n$ and the address electrode $A_m$; and the scan electrode $Y_n$ and the address electrode $A_m$.

Figure 2:
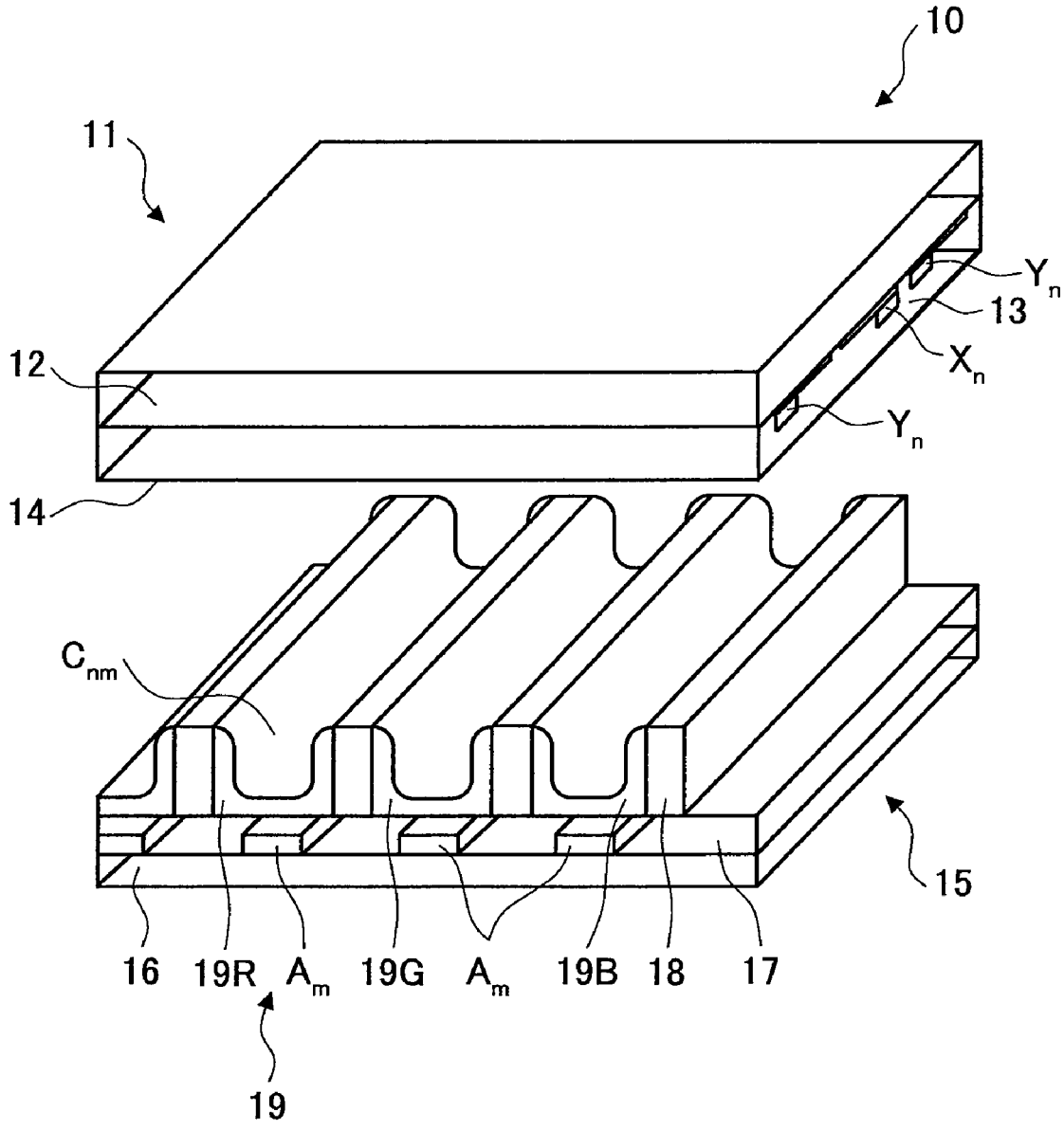
FIG. 2 is an exploded perspective view of a plasma display panel shown in FIG. 1.

FIG. 2 is an exploded perspective view of the plasma display panel 10. As shown in FIG. 2, the plasma display panel 10 includes an upper substrate 11 and a lower substrate 15. The plasma display panel 10 is formed so that the upper substrate 11 and the lower substrate 15 are adhered facing each other.

The upper substrate 11 includes a glass substrate 12, and the plural sustain electrodes $X_n$ and the plural scan electrodes $Y_n$ are extended in the horizontal direction (lateral direction) on the inner surface of the glass substrate 12 so that the sustain electrodes $X_n$ and the scan electrodes $Y_n$ are alternately disposed in the vertical direction (longitudinal direction). In addition, the upper substrate 11 includes a dielectric layer 13 and a protection film 14 formed of, for example, MgO (magnesium oxide), and the dielectric layer 13 covers the sustain electrodes $X_n$ and the scan electrodes $Y_n$, and the protection film 14 covers the dielectric layer 13.

The lower substrate 15 includes a glass substrate 16, and the plural address electrodes $A_m$ are extended in the vertical direction (longitudinal direction) on the inner surface of the glass substrate 16, and a dielectric layer 17 covers the plural address electrodes $A_m$ and the glass substrate 16. The address electrode $A_m$ is disposed so that the address electrode $A_m$ almost orthogonally crosses the sustain electrode $X_n$ and the scan electrode $Y_n$ in the planar view. In addition, plural ribs 18 are formed on the dielectric layer 17. Plural partitions are formed in the vertical direction (longitudinal direction) at the position where the upper substrate 11 faces the lower substrate 15 by the plural ribs 18, and the plural discharge cells $C_{nm}$ are formed by the partitions. That is, a region divided by the partitions at the position where the sustain electrode $X_n$ and the scan electrode $Y_n$ on the upper substrate 11 cross the address electrode $A_m$ on the lower substrate 15 forms the discharge cell $C_{nm}$.

In addition, on the surface of the discharge cell $C_{nm}$, that is, between the two adjacent ribs 18, a fluorescent substance 19 is applied. The fluorescent substance 19 includes a red fluorescent substance 19R, a green fluorescent substance 19G, and a blue fluorescent substance 19B, and a pixel is formed by the above three fluorescent substances 19R, 19G, and 19B. The fluorescent substance 19 emits corresponding visible light by being excited by ultraviolet light.

The upper substrate 11 and the lower substrate 15 are adhered so that the protection film 14 contacts the ribs 18, and a discharge gas, for example, Ne—Xe is supplied between the upper substrate 11 and the lower substrate 15. With this, the plasma display panel 10 is formed.

A light emission principle of the plasma display panel 10 is described. A discharge cell $C_{nm}$ from which light is emitted or not is selected by existence or non-existence of an address discharge, and light intensity is determined by the repeating number of sustain discharges after the selection.

First, when an address pulse is applied to an address electrode $A_m$ and a scan pulse is applied to a scan electrode $Y_n$, an address discharge is generated, and a wall electric charge is stored in a discharge cell $C_{nm}$. In the address discharge, a positive ON signal of the address pulse is applied to a discharge cell $C_{nm}$ to be lighted, and a ground potential OFF signal of the address pulse is applied to another discharge cell $C_{nm}$ to be unlighted. That is, ON/OFF signals corresponding to whether the discharge cells $C_{nm}$ are to be lighted or unlighted are simultaneously applied to all the address electrodes $A_1$ through $A_m$ at a timing when a negative scan pulse is applied to a line of the scan electrodes $Y_n$ which together perform an address selection. With this, the wall electric charge by the address discharge is stored only in a discharge cell $C_{nm}$ to be lighted. Then a scan pulse is sequentially applied to the scan electrodes $Y_1$ through $Y_n$, and the address selection is performed in all the surface of the plasma display panel 10.

A period in which an address discharge is generated and a discharge cell $C_{nm}$ to be lighted is selected is called the address period. In the plasma display panel driving method and the plasma display apparatus according to the embodiment of the present invention, driving control is performed so that a defect address discharge is not generated in the address period. The driving control is described below in detail.

After the address discharge, sustain pulses are applied to the corresponding sustain electrodes $X_n$ and scan electrodes $Y_n$; since a sufficient wall electric charge is stored in a discharge cell $C_{nm}$ where the address discharge is generated, a sustain discharge (repeating discharge) is generated in the discharge cell $C_{nm}$ and the discharge cell $C_{nm}$ is lighted, and another discharge cell $C_{nm}$ where the address discharge is not generated is not lighted due to having no sustain discharge. A period during which the sustain discharge is generated is called a sustain period.

When a defective address discharge is generated, a wall electric charge is not normally stored in the discharge cell $C_{nm}$, and in some cases, the sustain discharge may not be suitably performed. In the plasma display panel driving method and the plasma display apparatus according to the embodiment of the present invention, driving control preventing the defective sustain discharge by reducing the defective address discharge is performed. The driving control is described below in detail.

Returning to FIG. 1, other structural elements in the plasma display apparatus are described in detail.

The address electrode driving circuit 20 drives the address electrodes $A_m$. The address electrode driving circuit 20 supplies a positive address pulse having a predetermined voltage to the address electrode $A_m$ and generates an address discharge in the discharge cell $C_{nm}$. In the plasma display panel driving method and the plasma display apparatus according to the embodiment of the present invention, driving control is performed so that the address discharge is surely and suitably performed by controlling an address pulse waveform. The driving control is described below in detail.

The Y electrode driving circuit 40 drives the scan electrodes $Y_n$ and includes a scan driver 41 and a sustain driver 42.

The scan driver 41 supplies a scan pulse having a predetermined negative (polarity) voltage to a scan electrode $Y_n$ and generates an address discharge in a discharge cell $C_{nm}$ corresponding to control of the control circuit 50 and the sustain driver 42.

The sustain driver 42 repeatedly supplies a sustain pulse having a predetermined voltage to the scan electrode $Y_n$ and generates a sustain discharge in a discharge cell $C_{nm}$.

The X electrode driving circuit 30 drives the sustain electrodes $X_n$. The X electrode driving circuit 30 repeatedly supplies a sustain pulse having a predetermined voltage to the sustain electrode $X_n$ and generates a sustain discharge in a discharge cell $C_{nm}$. The sustain electrodes $X_n$ are connected to each other and have the same voltage level.

The control circuit 50 controls and drives the address electrode driving circuit 20, the X electrode driving circuit 30, and the Y electrode driving circuit 40. When an input signal S of one frame or one field of an image which is a general image signal is input to the control circuit 50, the control circuit 50 performs subfield conversion in which the image of one frame or one field is divided into plural subfields, and generates address data for driving the address electrode driving circuit 20 and generates scan data for driving the scan driver 41 of the Y electrode driving circuit 40. In addition, the control circuit 50 generates sustain data for driving the X electrode driving circuit 30 and the sustain driver 42 of the Y electrode driving circuit 40.

Figure 3:
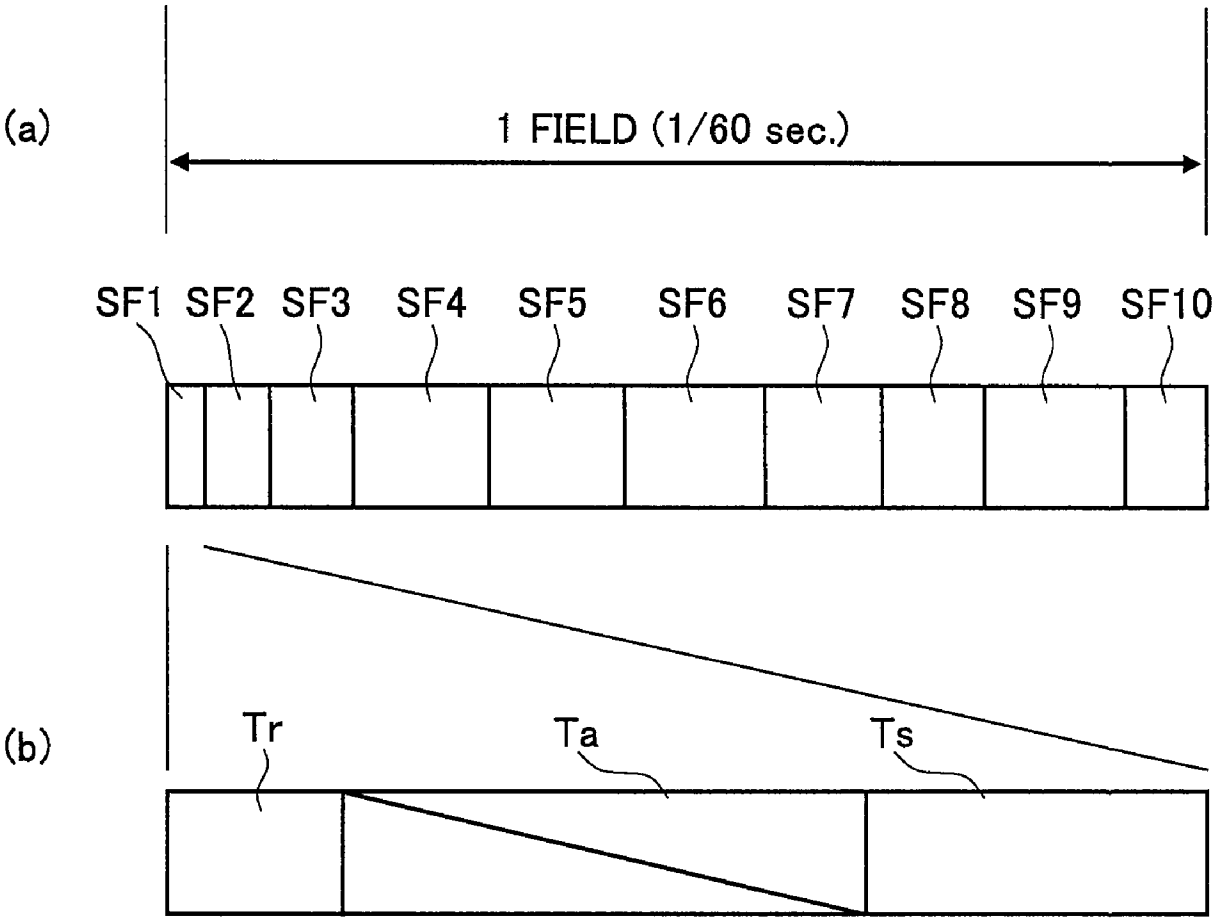
FIG. 3 is a schematic diagram showing a subfield driving method when an image of one field is displayed on the plasma display panel shown in FIG. 1.

Next, referring to FIG. 3, a subfield driving method of the plasma display system panel 10 is described.

FIG. 3 is a schematic diagram showing the subfield driving method when an image of one field is displayed on the plasma display panel 10. The subfield driving method is the address display period separated subfield method. In FIG. 3(*a*), one field of an image (one field is 1/60 sec.) is shown, and one field of the image is divided into the plural subfields SFs, and as an example, the number of the subfields SFs is 10. That is, one field of one image is divided into image elements of the subfields SF1 through SF10. In the plasma display panel driving method and the plasma display apparatus according to the embodiment of the present invention, one field of an image is divided into plural subfields SFs and the plasma display panel 10 is driven by using the subfield driving method by which gradations of the image are displayed. In the plasma display panel 10, the gradations of the image are displayed by the second power of the number of discharge times; therefore, the subfield driving method is used. In FIG. 3(*a*), one field of an image is received at 1/60 second, the one field of the image is divided into the 10 subfields, and the gradations of the image are displayed. In FIG. 3, the 10 subfields SFs are shown; however, the number of the subfields SFs can be, for example, 8 depending on application.

Discharge periods of one subfield are shown in FIG. 3(*b*). In FIG. 3(*b*), for example, the one subfield SF1 is divided into three discharge periods; that is, a reset period Tr, an address period Ta, and a sustain period Ts.

In the reset period Tr, the wall electric charge generated in the right previous sustain period Ts is erased in the discharge cell $C_{nm}$ and the wall electric charge in the discharge cell $C_{nm}$ is rearranged so as to support a discharge in the next address period Ta. With this, the wall electric charge in the discharge cell $C_{nm}$ is initialized.

In the address period Ta, an address discharge is generated for determining a discharge cell $C_{nm}$ to be lighted. After a discharge is generated between the address electrode $A_m$ and the scan electrode $Y_n$, a wall electric charge is generated in the discharge cell $C_{nm}$. In the address discharge, there are a system in which a wall electric charge is generated in a discharge cell $C_{nm}$ to be lighted and another system in which a wall electric charge is erased in a discharge cell $C_{nm}$ not to be lighted. In the plasma display panel driving method and the plasma display apparatus according to the embodiment of the present invention, the system is used in which the wall electric charge is generated in the discharge cell $C_{nm}$ to be lighted.

In the sustain period Ts, a discharge is repeatedly performed between a scan electrode $Y_n$ and a sustain electrode $X_n$ by a sustain discharge, and a discharge cell $C_{nm}$ selected by the address discharge is lighted.

Figure 4:
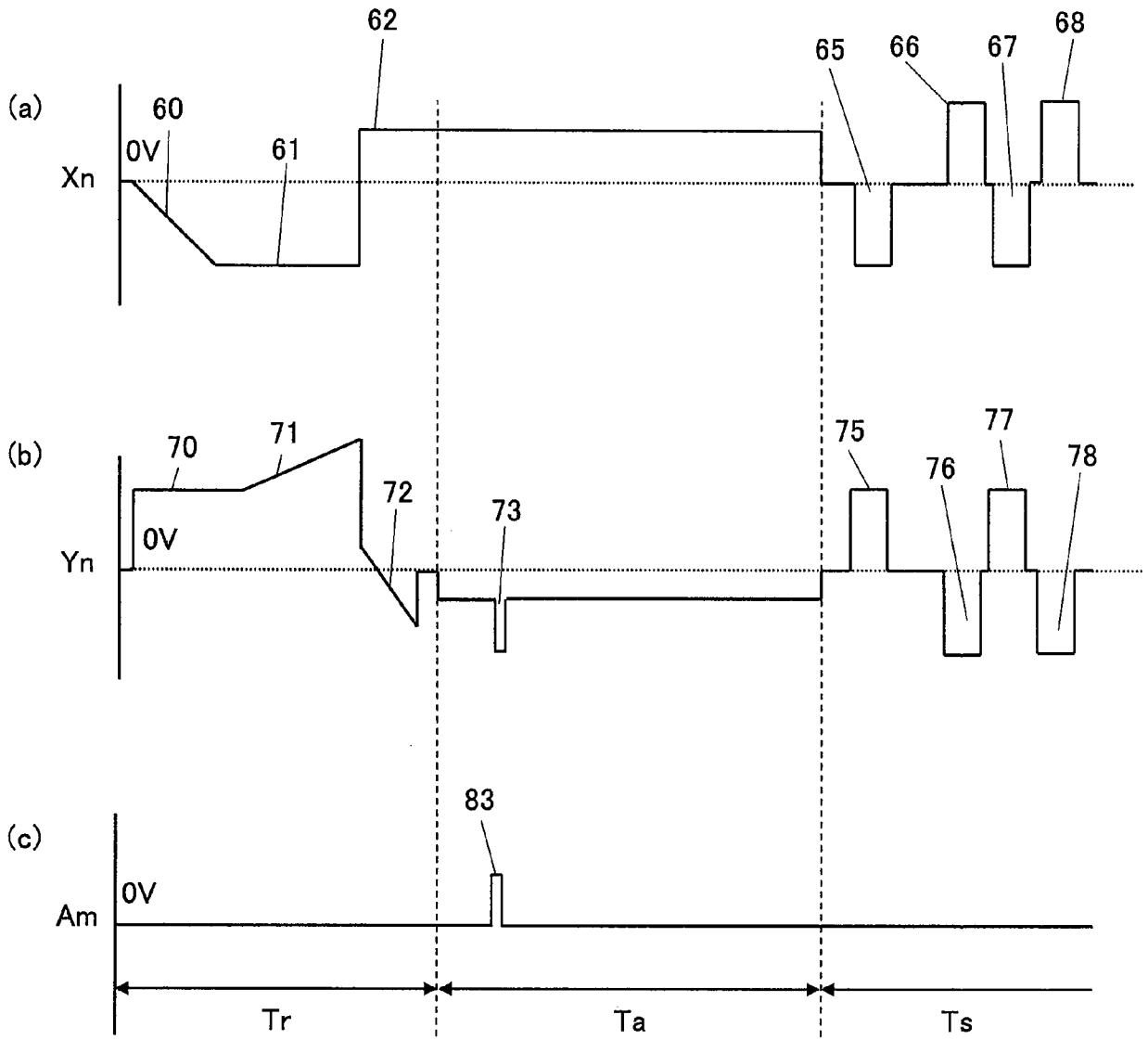
FIG. 4 is a diagram showing driving voltage waveforms to be applied to a sustain electrode, a scan electrode, and an address electrode in one subfield shown in FIG. 3.

Next, referring to FIG. 4, driving voltage waveforms in one subfield SF are described. FIG. 4 is a diagram showing driving voltage waveforms to be applied to a sustain electrode $X_n$, a scan electrode $Y_n$, and an address electrode $A_m$ in one subfield SF. FIG. 4(*a*) shows a driving voltage waveform to be applied to the sustain electrode $X_n$, FIG. 4(*b*) shows a driving voltage waveform to be applied to the scan electrode $Y_n$, and FIG. 4(*c*) shows a driving voltage waveform to be applied to the address electrode $A_m$.

In the reset period Tr, as shown in FIGS. 4(*a*) and 4(*b*), in order to erase a wall electric charge in a discharge cell $C_{nm}$ generated at the immediately previous sustain discharge, an X erasing slope wave 60 is applied to the sustain electrode $X_n$, and an Y erasing voltage 70 is applied to the scan electrode $Y_n$. Next, in order to generate a wall electric charge in a discharge cell $C_{nm}$, an X negative voltage 61 is applied to the sustain electrode $X_n$, and a Y writing slope wave 71 is applied to the scan electrode $Y_n$. Then, in order to erase a part of the wall electric charge in the discharge cell $C_{nm}$ with a necessary amount, an X positive voltage 62 is applied to the sustain electrode $X_n$ and a Y compensating slope wave 72 is applied to the scan electrode $Y_n$. With this, the discharge cell $C_{nm}$ enters into a reset state in which the discharge cell $C_{nm}$ has a suitable wall electric charge.

In the address period Ta, in order to determine a discharge cell $C_{nm}$ to be lighted, an address discharge is performed. In the address discharge, a scan pulse 73 for determining a scan electrode $Y_n$ in the row direction is applied to the scan electrode $Y_n$, and at the same time, an address pulse 83 for determining an address electrode $A_m$ in the column direction is applied to the address electrode $A_m$. The scan pulse 73 is applied to the scan electrodes $Y_1$ through $Y_n$ in order by shifting the applying timings. The address pulse 83 is applied to the address electrodes $A_m$ with the same timing as that of the scan pulse 73 so that the discharge cells $C_{nm}$ to be lighted at the positions where the scan electrodes $Y_n$ cross the corresponding address electrodes $A_m$ generate corresponding discharges. That is, in each row, the discharge cells $C_{nm}$ to be lighted are selected based on the output of the address pulse 83 to the address electrodes $A_m$. As shown in FIGS. 4(*b*) and 4(*c*), the scan pulse 73 is a negative pulse, and the address pulse 83 is a positive pulse.

In the address period Ta, as shown in FIG. 4(*a*), an X positive voltage 62 is applied to the sustain electrodes $X_n$. Since an address discharge is generated between the scan electrode $Y_n$ and the address electrode $A_m$, a wall electric charge is suitably generated in the discharge cell $C_{nm}$.

In the sustain period Ts, a first sustain pulse 65 is applied to the sustain electrodes $X_n$, and a first sustain pulse 75 is applied to the scan electrodes $Y_n$; next, sustain pulses 66, 67, and 68 are repeatedly applied to the sustain electrodes $X_n$, and sustain pulses 76, 77, and 78 are repeatedly applied to the scan electrodes $Y_n$. With this, the sustain discharge is continued in the discharge cells $C_{nm}$ selected in the address discharge, and an image is displayed on the plasma display panel 10.

Figure 5:
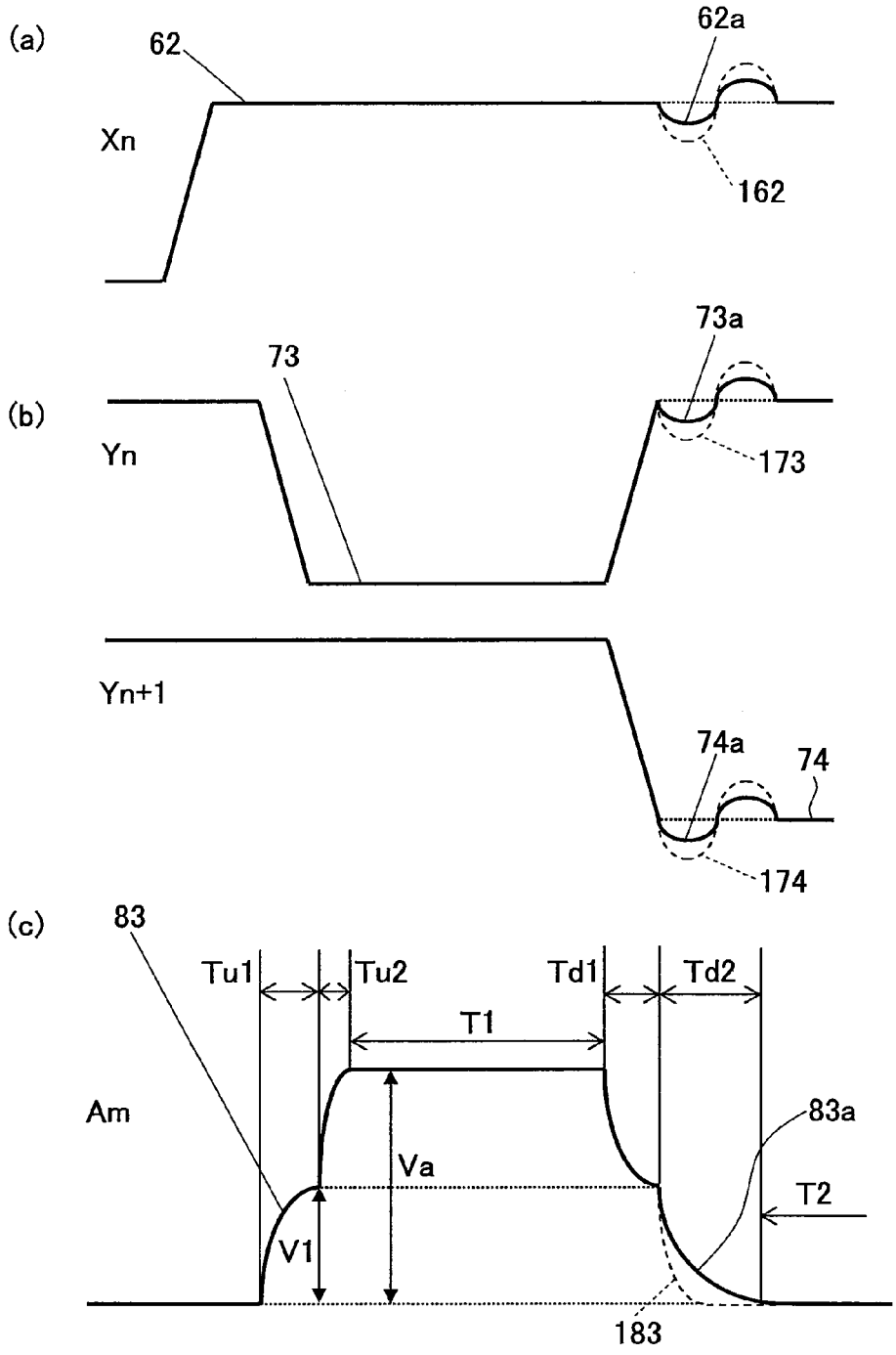
FIG. 5 is a diagram showing voltage waveforms to be applied to the sustain electrode, the scan electrode, and the address electrode in an address period.

Next, referring to FIG. 5, an address pulse driving method in the address period Ta is described in the plasma display panel driving method and the plasma display apparatus according to the embodiment of the present invention.

FIG. 5 is a diagram showing voltage waveforms to be applied to a sustain electrode $X_n$, a scan electrode $Y_n$, and an address electrode $A_m$ in the address period Ta. FIG. 5(*a*) shows a voltage waveform to be applied to the sustain electrode $X_n$, FIG. 5(*b*) shows a voltage waveform to be applied to the scan electrode $Y_n$, and FIG. 5(*c*) shows a voltage waveform to be applied to the address electrode $A_m$.

In FIG. 1, the sustain electrode $X_n$, the scan electrode $Y_n$, and the address electrode $A_m$ are shown. However, in the following, in some cases, a sustain electrode $X_{n+1}$ is shown so that a relationship between adjacent plural sustain electrodes $X_n$ is shown, a scan electrode $Y_{n+1}$ is shown so that a relationship between adjacent plural scan electrodes $Y_n$ is shown, and an address electrode $A_{m+1}$ is shown so that a relationship between adjacent plural address electrodes $A_m$ is shown.

In FIG. 5(*a*), an X positive voltage 62 is commonly applied to the sustain electrodes $X_n$. In FIG. 5(*b*), a scan pulse 73 is applied to an $n^{th}$ scan electrode $Y_n$, and a scan pulse 74 is applied to an $(n+1)^{th}$ scan electrode $Y_{n+1}$. In addition, in FIG. 5(*c*), an address pulse 83 is applied to an $m^{th}$ address electrode $A_m$ by being synchronized with the scan pulse 73.

In FIG. 5(*c*), the address pulse 83 has a Tu1 period, a Tu2 period, a T1 period, a Td1 period, a Td2 period, and a T2 period. In the Tu1 period, an intermediate voltage V1 is applied to the address electrode $A_m$ by being charged from adjacent address electrodes $A_{m-1}$, $A_{m+1}$, and more. In the Tu2 period, an address voltage Va is applied to the address electrode $A_m$ by being connected to a power source. In the T1 period, the address voltage Va is continuously applied to the address electrode $A_m$. In the Td1 period, the address electrode $A_m$ discharges electric charges to the adjacent address electrodes $A_{m-1}$, $A_{m+1}$, and more. In the Td2 period, the voltage of the address electrode $A_m$ falls to ground potential by being connected to a ground circuit. In the T2 period, the voltage of the address electrode $A_m$ maintains ground potential.

It is desirable to shorten the address period Ta; however, generally, it is required that the charging period and the discharging period in the charge sharing system are some 100 ns or more. The period Tu1 (charge period) which is a rise time of the address pulse 83 and the period Td1 (discharge period) which is a fall time of the address pulse 83 become long; however, the period Tu2 in which the address pulse 83 rises to the address voltage Va having a predetermined high voltage by clamping and the period Td2 in which the address pulse 83 falls to ground potential 0 V by clamping are desirable to be as short a time as possible. Therefore, in the conventional plasma display panel driving method and the conventional plasma display apparatus, in order to shorten the address period Ta as much as possible, the following are determined. That is, the charge period Tu1>the period Tu2 (voltage rising period by clamping), and the discharge period Td1>the period Td2 (voltage falling period by clamping). In FIG. 5(*c*), the broken line 183 shows the conventional case.

The electrodes in the plasma display panel 10 have a capacitive coupling relationship among the electrodes. Therefore, when a voltage change of an electrode is steep, the voltage change influences a voltage waveform to be applied to another electrode. In a case where an address electrode $A_m$ is studied, in a display pattern having a large change in which the number of the discharge cells $C_{nm}$ whose addresses are selected to be ON in one scan line is great and the number of the discharge cells $C_{nm}$ whose addresses are selected to be ON in the next scan line is small, when the voltage of the address electrode $A_m$ is changed, the change remarkably influences the next scan line.

That is, in a conventional address pulse waveform 183 whose period Td2 in which the voltage applied to the address electrode $A_m$ is lowered to 0 V is short, as shown in FIG. 5(*a*), the X positive voltage 62 to be applied to the sustain electrode $X_n$ is changed to a broken line 162, and the X positive voltage 62 largely fluctuates. In addition, as shown in FIG. 5(*b*), after the address discharge of the $n^{th}$ scan electrode $Y_n$, when the scan pulse 74 is applied to the $(n+1)^{th}$ scan electrode $Y_{n+1}$, a voltage change 174 of the scan pulse 74 is generated, and this change badly influences the address discharge.

By the scan pulse change 174, when a defective address discharge is generated between the scan electrode $Y_{n+1}$ and the address electrode $A_m$ and a wall electric charge is not sufficiently generated, a sustain discharge is not suitably generated between the sustain electrode $X_{n+1}$ and the scan electrode $Y_{n+1}$. Consequently, a discharge cell $C_{nm}$ to be lighted is not lighted and image quality is lowered.

In the plasma display panel driving method and the plasma display apparatus according to the embodiment of the present invention, as shown in the continuous line 83*a* of FIG. 5(*c*), the Td2 period in which a voltage to be applied to the address electrode $A_m$ falls to ground potential 0 V by being connected to the ground circuit is made longer than that in the conventional case. With this, the voltage changes in the sustain electrode $X_n$ and the scan electrode $Y_n$ are reduced.

Specifically, as shown in FIG. 5(*c*), the Td2 period in which a voltage to be applied to the address electrode $A_m$ falls to ground potential 0 V by being connected to the ground circuit is determined to be longer than the period Tu2 in which the power source voltage of the address-voltage Va is applied to the address electrode $A_m$ and the period Td1 in which the address electrode $A_m$ discharges the electric charge to the adjacent address electrodes $A_{m-1}$, $A_{m+1}$, and more. That is, it is determined that the period Tu2<the period Td2, and the period Td1<the period Td2.

For example, in a case where one address pulse period of the address pulse 83 is 1 to 2 μs, when the period Tu2 (clamp voltage rising period) is 50 to 200 ns, the period Td2 (clamp voltage falling period) can be 100 to 400 ns, twice the period Tu2. In addition, the period Td2 is automatically stopped when the next address pulse 83 is generated; therefore, the upper limit of the period Td2 is not necessarily determined. However, for example, the upper limit of the period Td2 can be 1 to 2 μs that correspond to the one address period or can be 250 to 1000 ns that correspond to five times the period Tu2 or less.

In this, it can be only determined that the period Tu2<the period Td2, and it can be determined that the period Td1<the period Td2 when it is necessary.

When the address electrode driving circuit 20 applies the address pulse 83*a* whose period Td2 is determined to be longer than the conventional case to the address electrode $A_m$, as shown in FIG. 5(*a*), the change of the X positive voltage 62 is lowered to the X positive voltage 62*a*. Similarly, as shown in FIG. 5(*b*), the scan pulse 74 to be applied to the scan electrode $Y_{n+1}$ becomes the voltage waveform 74*a* whose voltage change is lower than a voltage waveform 174 of the conventional case, and the address discharge is suitably performed.

In this, since the address discharge of the $n^{th}$ scan electrode $Y_n$ has been completed, the scan pulse 73 does not necessarily influence generating the wall electric charge in the $n^{th}$ line; however, as shown in FIG. 5(*b*), the scan pulse 73 of the $n^{th}$ scan electrode $Y_n$ is changed to the waveform 73*a* whose change is lower than the change of a conventional waveform 173. That is, the voltage change is reduced.

According to an experiment by the inventors of the present invention, when the period Td2 (clamp voltage falling period) was determined to be two or more times the period Tu2 (clamp voltage rising period), the voltage change of the X positive voltage 62 to be applied to the sustain electrode $X_n$, the voltage change of the scan pulse 73 to be applied to the scan electrode $Y_n$, and the voltage change of the scan pulse 74 to be applied to the scan electrode $Y_{n+1}$ were able to be reduced approximately 20% from the conventional case, and the number of the discharge cells $C_{nm}$ which were not lighted were able to be reduced.

Figure 6:
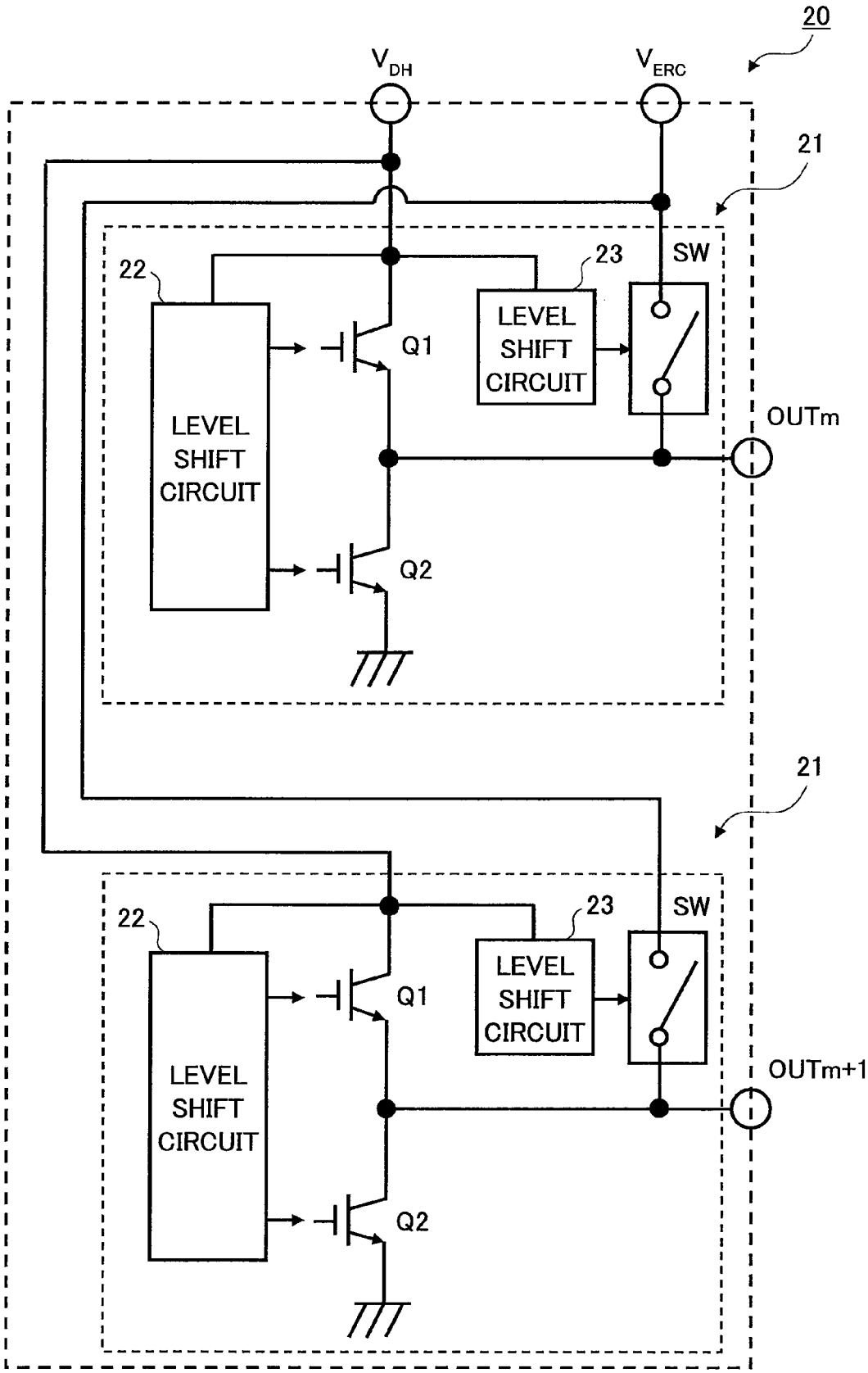
FIG. 6 is a circuit diagram showing the address electrode driving circuit in the plasma display apparatus according to the embodiment of the present invention.
Figure 7:
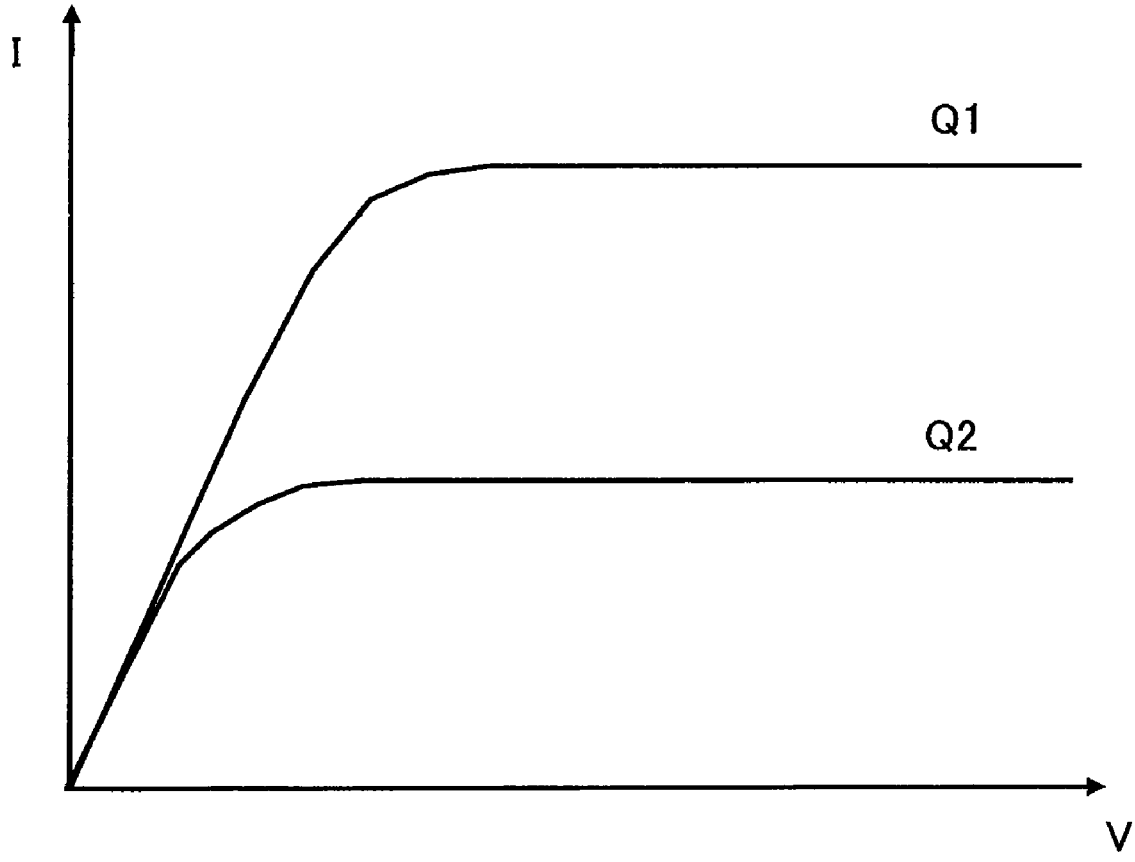
FIG. 7 is a graph showing voltage-current characteristics of a switching element for high voltage clamping and a switching element for low voltage clamping in the address electrode driving circuit shown in FIG. 1.
Figure 8:
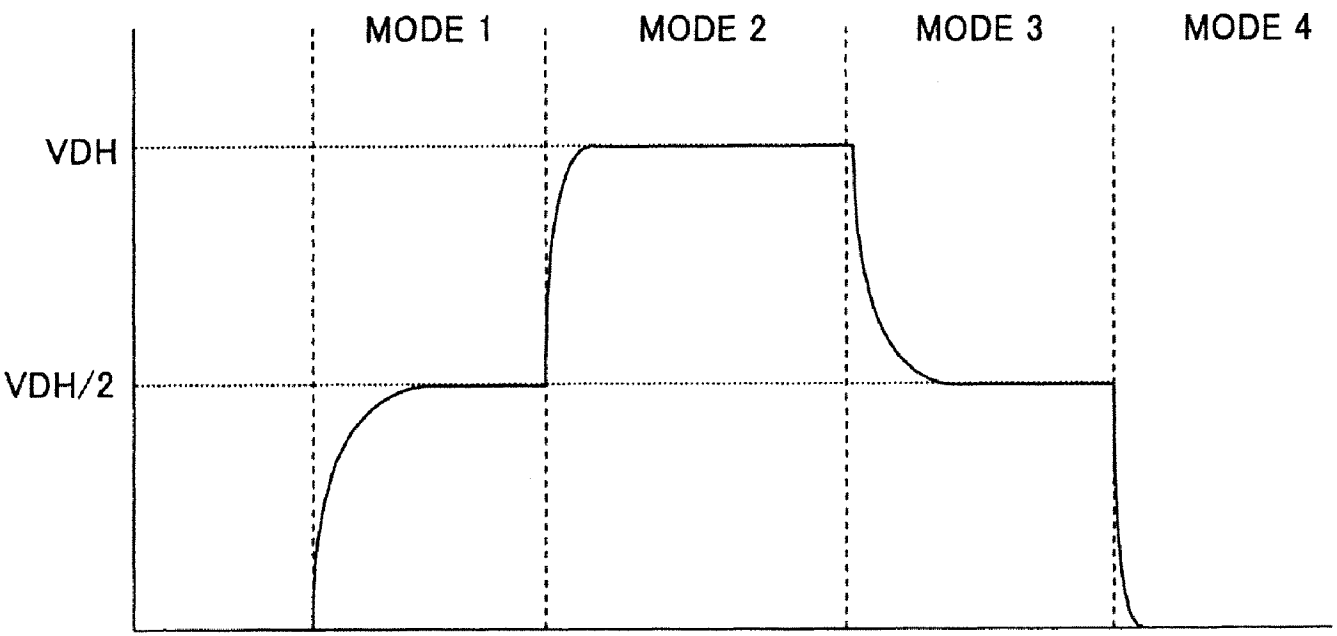
FIG.8 Prior Art
FIG. 8 is a diagram showing a voltage transition of an address pulse with the passage of time in a conventional charge sharing system.
Figure 9:
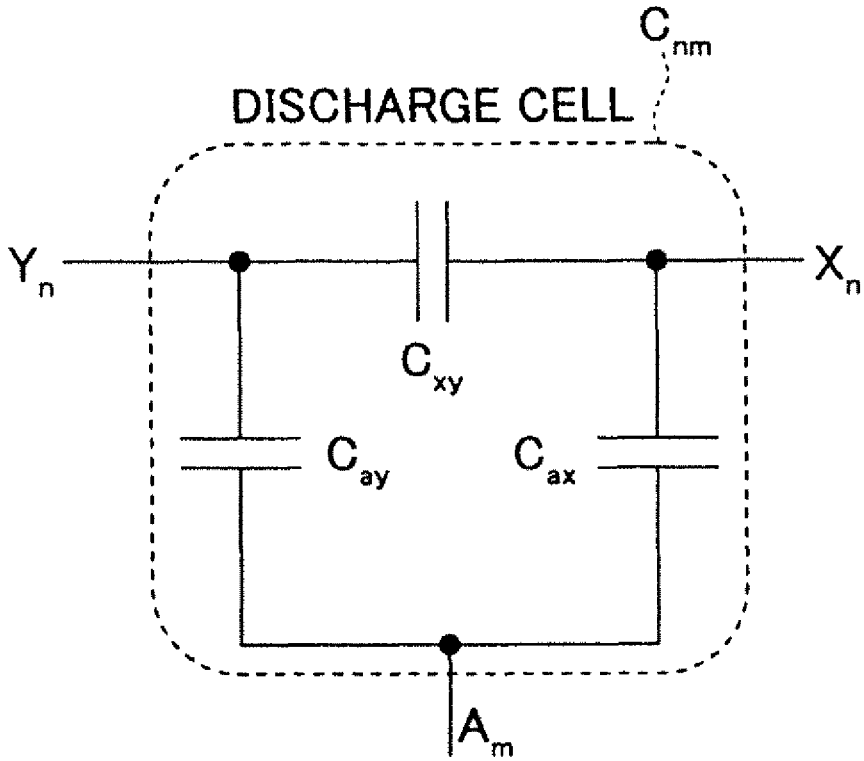
FIG.9 Prior Art
FIG. 9 is an equivalent circuit of a discharge cell of a plasma display panel.

Next, referring to FIGS. 6 and 7, a structure of the plasma display apparatus which realizes the plasma display panel driving method according to the embodiment of the present invention is described. FIG. 6 is a circuit diagram showing the address electrode driving circuit 20 in the plasma display apparatus according to the embodiment of the present invention. The address pulses 83 and 83*a* shown in FIG. 5 are output from an address pulse outputting circuit 21 in the address electrode driving circuit 20.

As shown in FIG. 6, the address electrode driving circuit 20 includes plural address pulse outputting circuits 21 corresponding to the address electrodes $A_1, A_2, \ldots, A_m$, and $A_{m+1}$. In FIG. 6, only the address pulse outputting circuits 21 for the address electrodes $A_m$ and $A_{m+1}$ are shown. That is, the structures of all the address pulse outputting circuits 21 are the same when there is no exception. For example, when the plasma display panel 10 includes 1920 pixels in the horizontal direction (lateral direction), since one pixel includes the three discharge cells $C_{nm}$ of red, green, and blue; the plasma display panel 10 includes 5760 address pulse outputting circuits 21.

Generally, some 100 address pulse outputting circuits 21 are integrated into one IC as an address driver IC. For example, when the plasma display panel 10 has the 1920 pixels in the horizontal direction and the address driver IC includes 192 outputs, the address electrode driving circuit 20 includes approximately 30 address driver ICs in three colors.

As shown in FIG. 6, the address pulse outputting circuit 21 includes a switching element SW for charge sharing, a switching element Q1 for high voltage clamping, a switching element Q2 for low voltage clamping, a level shift circuit 22 for the switching elements Q1 and Q2, and a level shift circuit 23 for the switching element SW.

The switching element SW for charge sharing switches to share electric charges in the address pulse outputting circuits 21 in the address diver IC. The switching elements SWs in the address pulse outputting circuits 21 are connected to each other. When a voltage to generate an address pulse for an $n^{th}$ scan electrode $Y_n$ is discharged, the switching element SW operates so that the discharge is used for generating an address pulse for an $(n+1)^{th}$ scan electrode $Y_{n+1}$. Specifically, when an address discharge is performed for the $n^{th}$ scan electrode $Y_n$, in the address electrodes $A_1, A_2, \ldots, A_{m-1}, A_m$, and $A_{m+1}$, some address electrodes $A_m$ output the address pulse and other address electrodes $A_m$ not output the address pulse are mixed; therefore, it is conceivable that approximately ½ electric charges are stored when the electric charges are averaged in the address electrodes $A_m$.

Consequently, after performing the address discharge for the $n^{th}$ scan electrode $Y_n$, at a timing when address pulse applied voltage is discharged, when switching elements SW are operated to make short-circuits, the discharge is used for generating an address pulse for an $(n+1)^{th}$ scan electrode $Y_{n+1}$. With this, a voltage rise to approximately ½ of the address voltage Va can be performed by charging by the charge sharing, and the electric charges generated at the previous address pulse generation can be effectively used.

As described above, by using the charge sharing system, the power efficiency in the address period Ta can be increased. When the address electrode driving circuit 20 includes the plural address driver ICs, the address driver ICs can be connected to perform the charge sharing, or the charge sharing can be performed in each address driver IC without connection.

The address electrode driving circuit 20 performs the address discharge by using the charge sharing system.

Returning to FIG. 5, operations of the switching element SW for charge sharing are described. In the address pulse 83, in the period Tu1 (charge period), the switching element SW is turned ON, and a charge is performed from an address electrode $A_m$ which performs an address pulse applying voltage discharge by completing the previous scan timing, and in the period Td1 (discharge period), the switching element SW is turned ON, and a discharge is performed to the address electrode $A_m$ which performs an address pulse applying voltage charge by starting the next scan timing. With this, the intermediate voltage V1 is supplied, the address pulse 83 rises from ground potential 0 V to the intermediate voltage V1 in the period Tu1 (charge period), and the address pulse 83 falls from the address voltage Va to the intermediate voltage V1 in the period Td1 (discharge period).

The switching element SW for charge sharing can be a semiconductor switching element such as a MOS (metal oxide semiconductor) transistor, a bipolar transistor, and an IGBT (insulated gate bipolar transistor); or another switching element, for example, a relay.

Returning to FIG. 6, the switching element Q1 for high voltage clamping clamps a voltage of the address electrode $A_m$ to the address voltage Va (power source voltage) supplied from a power source terminal $V_{DH}$. In the address pulse 83 shown in FIG. 5, in the period Tu2 (voltage rising period by clamping; high voltage clamp period), the switching element Q1 for high voltage clamping is turned ON, and the address pulse 83 rises from the intermediate voltage V1 to the address voltage Va.

The switching element Q2 for low voltage clamping clamps the voltage of the address electrode $A_m$ to ground potential 0 V by connecting to the ground circuit. In the address pulse 83 shown in FIG. 5, in the period Td2 (voltage falling period by clamping; low voltage clamp period), the switching element Q2 is turned ON, the address pulse 83 falls from the intermediate voltage V1 to ground potential 0 V.

In FIG. 6, each of the switching elements Q1 and Q2 is formed of a bipolar transistor. However, each of the switching elements Q1 and Q2 can be formed of a semiconductor switching element such as a MOS transistor, an IGBT; or another switching unit.

The level shift circuit 22 for the switching elements Q1 and Q2 is an adjusting circuit which supplies a voltage to a gate or a current to a base of each of the switching elements Q1 and Q2 for suitably operating the switching elements Q1 and Q2. The plasma display apparatus is operated by a high voltage of approximately 100 V or more; therefore, the switching elements Q1 and Q2 are formed of elements for a high voltage. Since the operating voltage for the switching elements Q1 and Q2 is high, the level shift circuit 22 adjusts, for example, the gate operations of the switching elements Q1 and Q2.

The level shift circuit 23 for the switching element SW for charge sharing is an adjusting circuit for suitably operating the switching element SW, and has a function similar to the function of the level shift circuit 22.

In the address electrode driving circuit 20 shown in FIG. 6, conventionally, the characteristics of the switching elements Q1 and Q2 are the same. However, in the address electrode driving circuit 20 of the plasma display apparatus according to the embodiment of the present invention, in order to make the period Td2 (address pulse falling time) longer than the period Tu2 (address pulse rising time), the characteristics of the switching element Q1 are different from the characteristics of the switching element Q2. The period Tu2 and the period Td2 of the address pulse 83 are determined by current flowing ability, for example, current capacity and ON resistance values of the switching elements Q1 and Q2.

FIG. 7 is a graph showing voltage-current characteristics of the switching element Q1 for high voltage clamping and the switching element Q2 for low voltage clamping in the address electrode driving circuit 20. In FIG. 7, the horizontal axis shows voltage and the vertical axis shows current.

In FIG. 7, when the same voltage is applied to the gates of the switching elements Q1 and Q2, a current flowing into the switching element Q2 is smaller than the current flowing into the switching element Q1. That is, the current capacity of the switching element Q2 is smaller than the current capacity of the switching element Q1.

By the above characteristics, even if the switching element Q2 for low voltage clamping is turned ON, the current flowing into the switching element Q2 is restricted to be a small amount, and the address pulse 83 of the address electrode $A_m$ at the falling time is gentle and is slower than at the rising time. That is, the falling time of the address pulse 83 is longer than the rising time.

As described above, when the current capacity of the switching element Q2 is smaller than the current capacity of the switching element Q1, as shown in FIG. 5(*c*), the address pulse 83 outputs the address pulse 83*a* having a gentle fall, and an influence to the sustain electrodes $X_n$ and the scan electrodes $Y_n$ can be reduced.

In FIG. 7, each of the switching elements Q1 and Q2 is formed of a MOS transistor. However, when each of the switching elements Q1 and Q2 is formed of a bipolar transistor, collector current-base current characteristics of the bipolar transistor can be used, and it is determined that the current capacity of the switching element Q2 is smaller than the current capacity of the switching element Q1.

Further, the present invention is not limited to the specifically disclosed embodiment, and variations and modifications may be made without departing from the scope of the present invention.

The present application is based on Japanese Priority Patent Application No. 2008-078803 filed on Mar. 25, 2008, with the Japanese Patent Office, the entire contents of which are hereby incorporated herein by reference.

What is claimed is:

1. A plasma display panel driving method for driving a plasma display panel which includes a plurality of scan electrodes extending in a first direction and a plurality of address electrodes extending in a second direction orthogonal to the first direction in which a negative polarity scan pulse is applied to one of the scan electrodes and a positive polarity address pulse is applied to one of the address electrodes from an address electrode driving circuit to generate an address, wherein:

the positive polarity address pulse is generated by using a charge sharing system, in which before clamping the one of the address electrodes at a predetermined high voltage or a predetermined low voltage, an averaged voltage generated by short-circuiting the plural address electrodes and thereby averaging electric charges remaining in the plural address electrodes is applied to the one of the address electrodes;

a falling time of the address pulse falling from the averaged voltage to the predetermined low voltage as a result of the clamping is longer than a rising time of the address pulse rising from the averaged voltage to the predetermined high voltage as a result of the clamping;

the rising time is shorter than a charge sharing rise time of the address pulse from the predetermined low voltage to the averaged voltage;

the falling time is longer than a charge sharing fall time of the address pulse from the predetermined high voltage to the averaged voltage; and clamping of the one of the address electrodes at the predetermined low voltage starts after the scan pulse applied to the one of the scan electrodes falls to a lower voltage and after the scan pulse applied to another one of the scan electrodes rises to a higher voltage.

2. The plasma display panel driving method as claimed in claim 1, wherein:

a period required for the address pulse to fall to the predetermined low voltage by clamping is 2 or more times a period required for the address pulse to rise to the predetermined high voltage by clamping and is one address pulse period or less.

3. The plasma display panel driving method as claimed in claim 2, wherein:

the period required for the address pulse to fall to the predetermined low voltage by clamping is 2 or more times and 5 or less times the period required for the address pulse to rise to the predetermined high voltage by clamping.

4. The plasma display panel driving method as claimed in claim 3, wherein:

the period required for the address pulse to fall to the predetermined low voltage by clamping is longer than a period required for the address pulse to fall to the averaged intermediate voltage by the charge sharing system.

5. A plasma display apparatus, comprising:

a plasma display panel which includes a plurality of scan electrodes extending in a first direction and a plurality of address electrodes extending in a second direction orthogonal to the first direction; and an address electrode driving circuit which generates an address discharge by applying a positive polarity address pulse to one of the address electrodes when a negative polarity scan pulse is applied to one of the scan electrodes, wherein the address electrode driving circuit includes:

a first switching element for a charge sharing system which applies an averaged voltage generated by short-circuiting the plural address electrodes and thereby averaging electric charges remaining in the plural address electrodes to one of the address electrodes before clamping the one of the address electrodes at a predetermined high voltage or a predetermined low voltage;

a second switching element for high voltage clamping which clamps the one of the address electrodes at the predetermined high voltage; and a third switching element for low voltage clamping which clamps the one of the address electrodes at the predetermined low voltage; wherein:

a limiting resistor is provided between a power supply supplying the predetermined high voltage and the second switching element;

a current capacity of the third switching element is made smaller than the current capacity of the second switching element so that:

a falling time of the address pulse falling from the averaged voltage to the predetermined low voltage as a result of low voltage clamping is longer than a rising time of the address pulse rising from the average voltage to the predetermined high voltage as a result of high voltage clamping, the rising time is shorter than a charge sharing rise time of the address pulse from the predetermined low voltage to the averaged voltage, and the falling time is longer than a charge sharing fall time of the address pulse from the predetermined high voltage to the averaged voltage; and the third switching element starts clamping the one of the address electrodes at the predetermined low voltage after the scan pulse applied to the one of the scan electrodes falls to a lower voltage and after the scan pulse applied to another one of the scan electrodes rises to a higher voltage.

6. The plasma display apparatus as claimed in claim 5, wherein:

a period from when the address electrode turns ON the third switching element to when the address electrode becomes the predetermined low voltage is 2 or more times a period from when the address electrode turns ON the second switching element to when the address electrode becomes the predetermined high voltage, and is one address period or less.

7. The plasma display apparatus as claimed in claim 6, wherein:

the period from when the address electrode turns ON the third switching element to when the address electrode becomes the predetermined low voltage is 2 or more times and 5 or less times the period from when the address electrode turns ON the second switching element to when the address electrode becomes the predetermined high voltage.

8. The plasma display apparatus as claimed in claim 7, wherein:

the period from when the address electrode turns ON the third switching element to when the address electrode becomes the predetermined low voltage is longer than a period from when the address electrode applies the predetermined high voltage to when the address electrode becomes an averaged voltage generated from electric charges remaining in the plural address electrodes by turning ON the first switching element.

* * * * *